US008434644B1

(12) United States Patent
Galante

(10) Patent No.: US 8,434,644 B1
(45) Date of Patent: May 7, 2013

(54) TUBE SQUEEZER

(75) Inventor: Stephen C. Galante, Denver, CO (US)

(73) Assignee: Product Evolutions, LLC, Denver, CO (US)

( * ) Notice: Subject to any disclaimer, the term of this patent is extended or adjusted under 35 U.S.C. 154(b) by 0 days.

(21) Appl. No.: 13/366,334

(22) Filed: Feb. 5, 2012

(51) Int. Cl.
*B65D 35/28* (2006.01)

(52) U.S. Cl.
USPC ..... 222/102

(58) Field of Classification Search ..... 222/102, 222/100, 101, 99, 98, 1, 92, 93, 95, 613, 222/191, 520, 105, 323, 469, 472, 473; 248/108, 248/109
See application file for complete search history.

(56) References Cited

U.S. PATENT DOCUMENTS

| | | | | | |
|---|---|---|---|---|---|
| 1,311,085 | A | | 7/1919 | Mucher | |
| 1,386,966 | A | | 8/1921 | Slade | |
| 1,721,981 | A | | 7/1929 | Werner | |
| 1,777,906 | A | | 10/1930 | Winsor | |
| 1,793,787 | A | | 2/1931 | Ertola | |
| 2,066,245 | A | * | 12/1936 | Bauman | 222/80 |
| 2,357,351 | A | | 9/1944 | Oliver | |
| 2,566,503 | A | | 9/1951 | Synder | |
| 2,622,768 | A | * | 12/1952 | Hatcher | 222/102 |
| 2,686,614 | A | | 8/1954 | Geressy et al. | |
| 2,690,858 | A | | 10/1954 | Peralta et al. | |
| 3,249,258 | A | | 5/1966 | Kramer et al. | |
| 3,291,344 | A | | 12/1966 | Meyer | |
| 3,581,943 | A | | 6/1971 | Koenigshof et al. | |
| 3,586,213 | A | * | 6/1971 | Gill | 222/102 |
| 3,606,090 | A | | 9/1971 | Byers | |
| 4,205,764 | A | | 6/1980 | Gill | |
| 4,354,623 | A | | 10/1982 | Gill et al. | |
| 4,998,645 | A | | 3/1991 | Pearson | |
| 5,511,696 | A | | 4/1996 | Gustafson | |
| 5,775,540 | A | * | 7/1998 | Greenberg | 222/102 |
| D399,110 | S | | 10/1998 | Schulz et al. | |
| D437,160 | S | | 2/2001 | Broussard | |
| 6,966,457 | B1 | | 11/2005 | Torbet | |
| 2009/0302054 | A1 | | 12/2009 | Cragnolini | |

* cited by examiner

*Primary Examiner* — Paul R Durand
*Assistant Examiner* — Benjamin R Shaw
(74) *Attorney, Agent, or Firm* — Christopher J. Kulish

(57) ABSTRACT

The present invention is directed to a two-handed tube squeezer for facilitating the expulsion of material from a collapsible container. In one embodiment, the tube squeezer includes a pair of frames that each has a handle portion and a tube engagement portion that supports a roller. The frames are connected by a hinge. When the frames are substantially parallel to one another, the handle and tube engagement portions all lie in a low profile plane. The handle portions also form a handle that is separated from the tube engagement portions. When a user is holding the handle with one hand and causing the rollers to squeeze a tube with the other hand, the hand that is holding the handle is separated from the tube engagement portions such that the squeezed portion of the tube is unlikely to come in contact with the hand that is gripping the handle.

3 Claims, 10 Drawing Sheets

TUBE SQUEEZER

FIELD OF THE INVENTION

The present invention relates to a tube squeezer for squeezing material out of a collapsible tube.

BACKGROUND OF THE INVENTION

The collapsible tube is a common structure for dispensing relatively viscous materials, such as caulk, ointments, certain pharmaceutical preparations, salves, and toothpaste, to name a few. The typical collapsible tube includes a flexible tubular body with a first end that is closed and a second end that is connected to a dispensing head. The dispensing head commonly includes a nozzle that defines an opening through which the material contained within the tube is dispensed. Typically, the dispensing head includes a cap that allows the opening to be sealed and unsealed as needed. The flexible tubular body is made of a ductile metal, plastic, or laminate. In operation, the opening is unsealed and the user squeezes the body to force some of the material contained within the tube out of the opening.

A problem with collapsible tubes is that in many instances a significant amount of material contained within the tube cannot be extracted. This particularly is the case when the only tool available to squeeze the body is the user's hand. This un-extracted material typically adheres to the interior side of the body and/or is located in the dispensing head. In some instances, the tube is cut open to extract the remaining material.

To address this problem, various tube squeezers have been developed. These tube squeezers fall into two types. The first type of tube squeezer is mounted on a surface and has a structure that pinches the tubular body between two surfaces (e.g., a pair of rollers) that span the width of the tubular body. The squeezer operates to either move the tube relative to the two surfaces or move the two surfaces relative to the tube. In either case, the movement squeezes the tube such that material within the tube is ejected from the nozzle. By squeezing from the closed end of the tube towards the dispensing head, the ejection of most all of the material in the tube is achieved. The second type of tube squeezer is hand-held and includes a structure that pinches the tubular body between two surfaces (e.g., a pair of rollers) that span the width of the tube. The squeezer operates such that the tube is moved relative to the two surfaces that provide the force to eject the material out of the nozzle. With respect to the second type of tube squeezers, there are at least two sub-types of squeezers. In the first sub-type, a handle structure allows the user to both grip the tube squeezer and cause the tube to move relative to the two surfaces using only one hand. The second sub-type of tube squeezer is designed to be operated using two hands, one hand grasps a handle and the other hand operates a lever, knob, or other actuator that causes the tube to move relative to the two surfaces that provide the force to eject the material through the nozzle of the tube.

SUMMARY OF THE INVENTION

The present invention is directed to a tube squeezer that is designed to be operated with two hands, i.e., there is a handle that the user grasps to hold the squeezer and a lever, knob, or other actuator that is used to move the tube relative to two surfaces that squeeze the tube to cause the material within the tube to be ejected from the tube nozzle. One embodiment of the invention recognizes and addresses several drawbacks associated with the known two-handed tube squeezers. To elaborate, one drawback associated with the known two-handed tube squeezers is that the portion of the tube that has been squeezed can interfere with the user's grip of the squeezer and/or begin to obscure the user's view of the application of the material from tube onto a surface. Another problem is that known two-handed tube squeezers are awkward or difficult to store in a tool box or on a tool board or carry on one's person when not in use.

To address these problems, one embodiment of the tube squeezer is comprised of two frames that each includes a handle portion and tube engagement portion. A roller is associated with the tube engagement portion of each of the frames. The two rollers provide the two surfaces that are used to squeeze a tube. A hinge connects the first and second frames to one another and allows the frames and their associated rollers to pivot relative to one another. Operatively connected to one of the rollers is a roller handle that the user manipulates with one hand to cause the rollers to move the tube relative to the rollers. A diverter is associated with the second frame and operates to direct the portion of a tube that has been squeezed towards a hole that is defined by the second frame. The hinge allows the frames to be placed in a position in which the longitudinal axes of the frames are parallel to, but separated from, one another. When the frames are in this position, (a) the handle portions of the first and second frames form a handle of sufficient length and circumference to be gripped by one hand of a typical user, the other hand of the user being employed to manipulate the roller handle; (b) the handle has a longitudinal axis that is perpendicular to a plane defined by the rotational axes of the roller, (c) the rollers are positioned to squeeze a tube, and (d) the diverter is positioned to direct the squeezed portion of the tube away from the volume around the handle that is typically occupied by the user's hand and in a direction that is unlikely to interfere with the user's viewing of the ejection of the material from the tube and onto a surface in many instances.

DETAILED DESCRIPTION

Figure 1A:
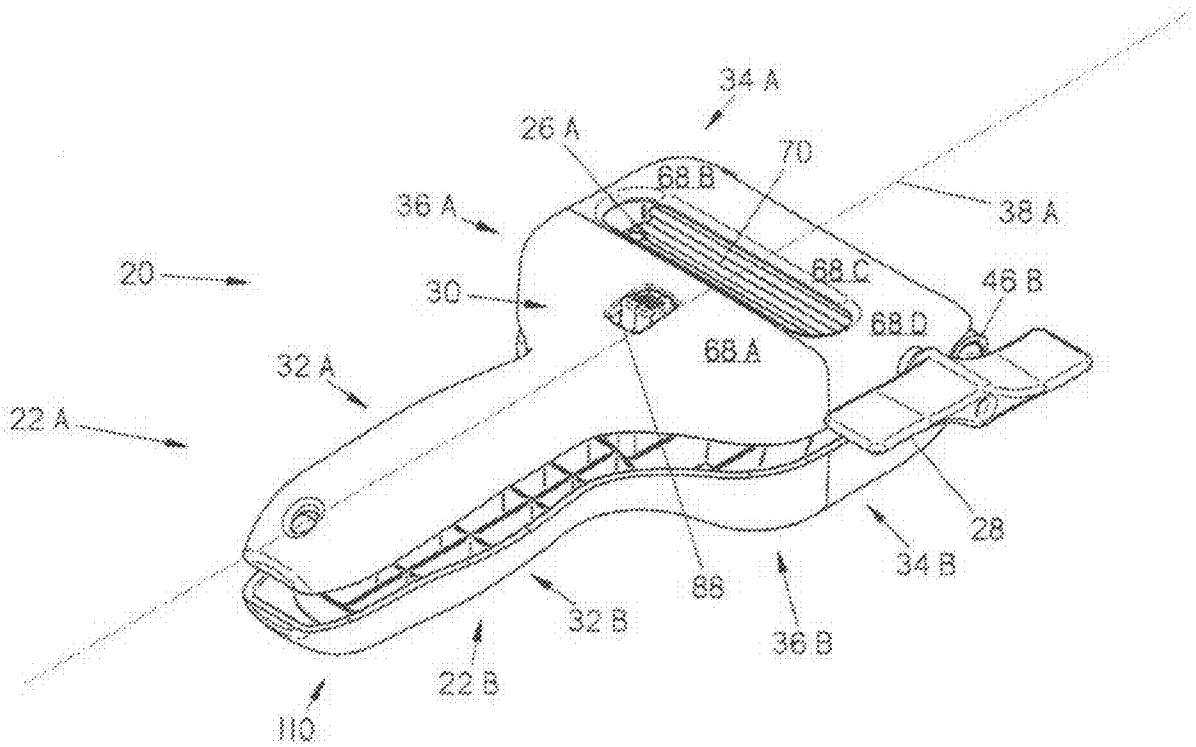
FIGS. 1A, 1B, and 1C respectively are a top side perspective view, bottom side perspective view, and front side plan view of an embodiment of a tube squeezer of the present invention.
Figure 1B:
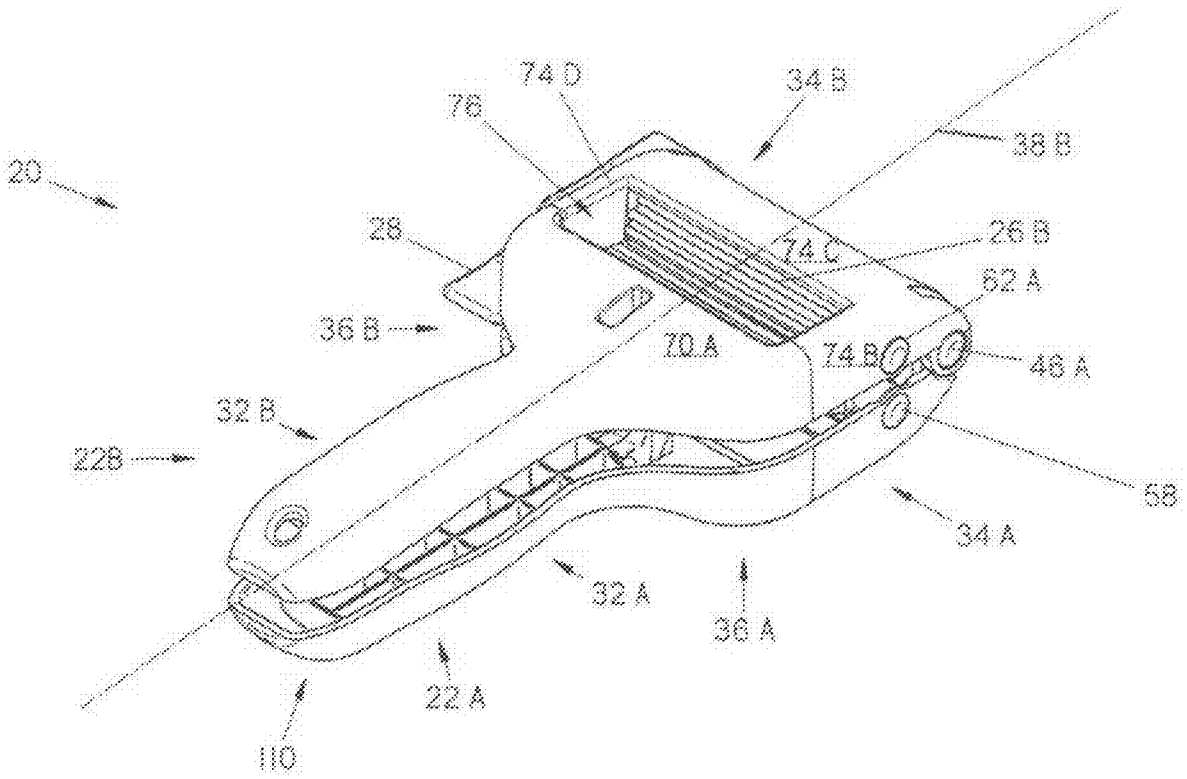
Figure 1C:
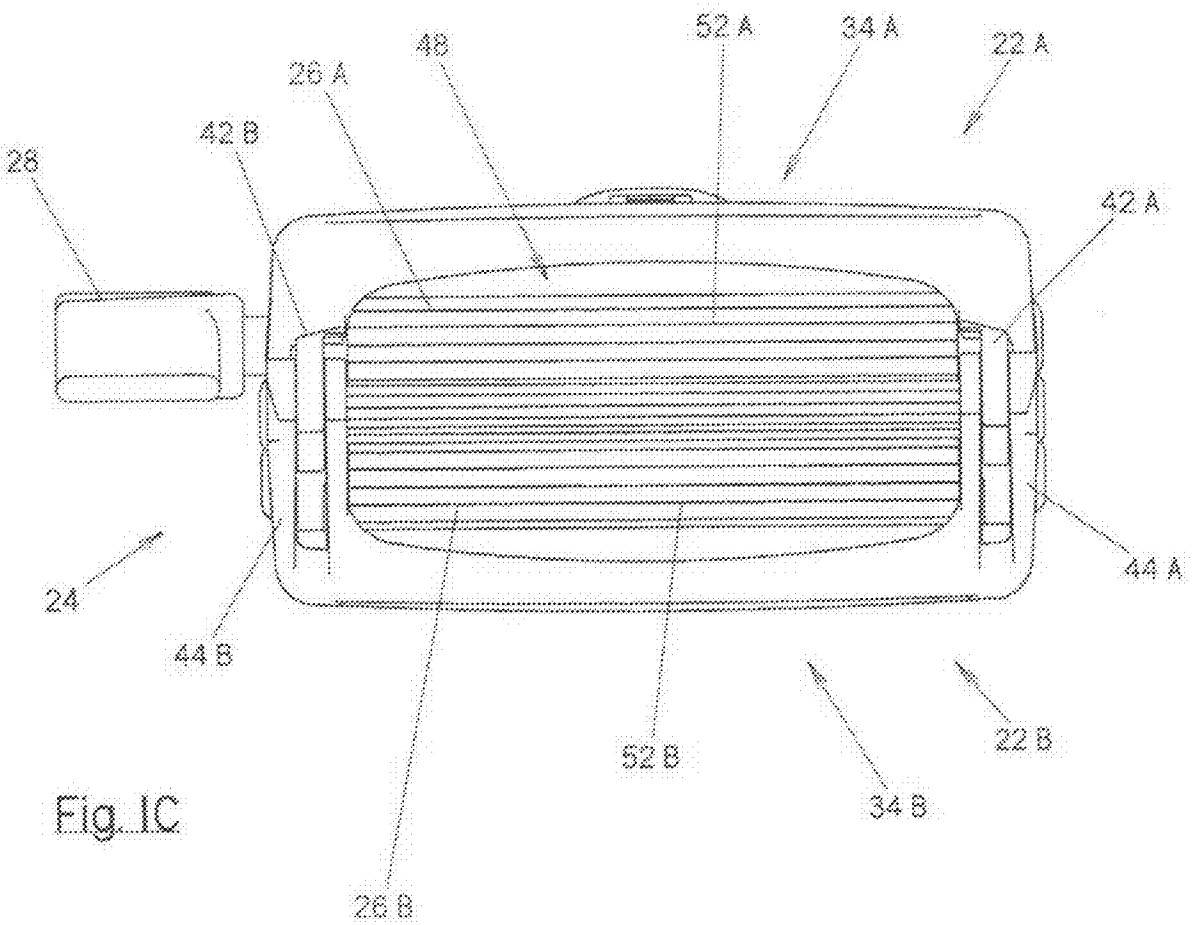

With reference to FIGS. 1A-1C, 2A-2B, and 3-5, an embodiment of a tube squeezer, hereinafter referred to as tube squeezer 20, is described. Generally, the tube squeezer 20 includes: (a) first and second frames 22A, 22B, (b) a hinge 24 connecting the first and second frames 22A, 22B to one another and allowing rotation of one frame relative to the other frame, (c) first and second rollers 26A, 26B respectively associated with the first and second frames 22A, 22B, (d) a roller handle 28 operatively attached to the first roller 26A, and (e) a latch 30 for connecting the first and second frames 22A, 22B so as to prevent rotation of one frame relative to the other frame.

The first frame 22A is comprised of a first handle portion 32A, a first tube engagement portion 34A, and a first latch portion 36A that is located between the first handle portion 32A and first tube engagement portion 34A. The first frame 22A also has a first handle longitudinal axis 38A. The second frame 22B is comprised of a second handle portion 32B, a second tube engagement portion 34B, and a second latch portion 36B that is located between the second handle portion 32B and the second tube engagement portion 34B. The second frame has a second longitudinal axis 38B. The first and second frames 22A, 22B are made from nylon and molded so that the frames are both lightweight and relatively rigid. However, it should be appreciated that other materials can be used to realize suitable frames, such as other plastics, metals and woods to name a few.

The hinge 24 includes a first pair of wings 42A, 42B that are attached to the first frame 22A, a second pair of wings 44A, 44B that are attached to the second frame 22B, and a pair of pins 46A, 46B. The wings 42A, 42B each define a hole for respectively receiving pins 46A, 46B. The wings 44A, 44B each define a slot for respectively receiving wings 42A, 42B and a pair of holes for respectively receiving pins 46A, 46B. The first pair of wings 42A, 42B are integral with the first frame 22A, i.e., the first pair of wings 42A, 42B are created in the same mold as the first frame 22A. The second pair of wings 44A, 44B are integral with second frame 22B. As such, the first and second pairs of wings 42A, 42B, 44A, and 44B are also made of nylon. The pins 46A, 46B each include a rod that passes through the holes defined by the wings and a head located at each end to engage the outer surfaces of the second pair of wings 44A, 44B. The hinge 24 is located such that the first and second rollers 26A, 26B are located in between the hinge 24 and the first and second handle portions 32A, 32B. The hinge 24 and the front of the first and second tube engagement portions 34A, 34B define an opening 48 through which one end of a tube can be inserted into the tube squeezer 20. It should be appreciated that other hinge structures and other locations for a hinge are feasible. For example, one or more wings can be realized that are each attached to one of the frames with a fastener, rather than being integral with the frame. Further, a hinge can be located between the rollers and the handle portions, as in a pair of scissors. Such a hinge would not, however, be capable of the additional function of partially defining an opening for receiving a tube. On the other hand, such a hinge could be comprised of a single wing structure associated with each frame and a single pin connecting the two wing structures.

The first roller 26A is comprised of a toothed outer portion 52A and a sleeve 54A. The sleeve 54A is comprised of a first portion that extends beyond one lateral end of the toothed outer portion 52A and a second portion that extends beyond the other lateral end of the toothed outer portion 52A. In the illustrated embodiment, the toothed outer portion 52A and sleeve 54A are a single, molded piece. It should be appreciated that multiple pieces can be joined to one another to realize the tooth outer portion 52A and sleeve 54A. A rivet 58 passes through hole 56A and engages the first portion of the sleeve 54A A pin 59 passes through hole 56B and engages the second portion of the sleeve 54A. The rivet 58 and pin 59 define the axis around which the first roller 26A rotates. The pin 59 also engages the handle 28.

The second roller 26B is comprised of a toothed outer portion 52B and a sleeve 54B. The sleeve 54B is comprised of a first portion that extends beyond one lateral end of the toothed outer portion 52B and a second portion that extends beyond the other lateral end of the toothed outer portion 52B. In the illustrated embodiment, the toothed outer portion 52B and sleeve 54B are a single, molded piece. It should be appreciated that multiple pieces can be joined to one another to realize the tooth outer portion 52B and sleeve 54B. Rivets 62A, 62B respectively pass through the holes 60A, 60B and respectively engage the first and second portions of the sleeve 54B. The rivets 62A, 62B define the axis around which the second roller 26B rotates.

Figure 2A:
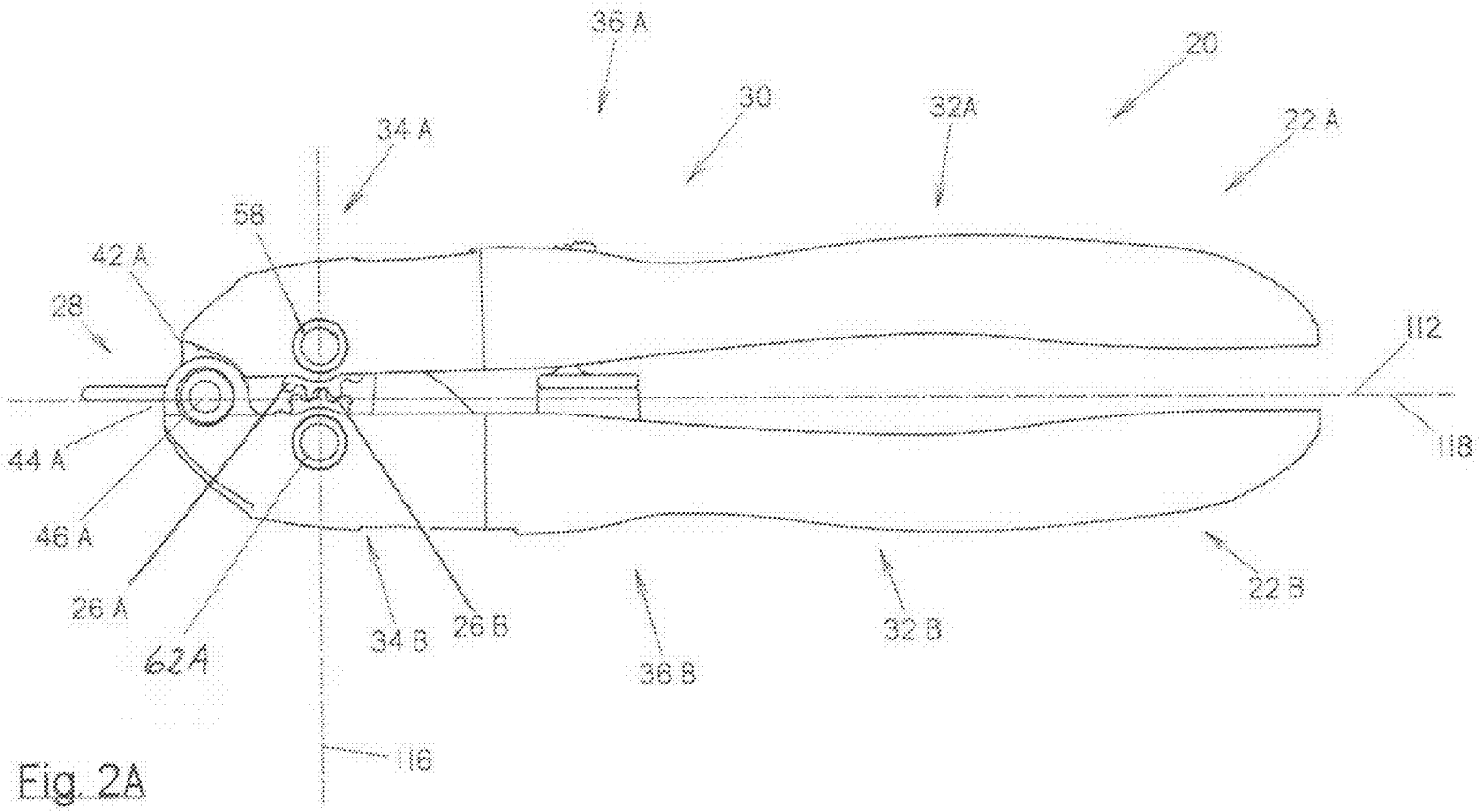
FIGS. 2A and 2B respectively are a first side view and a second side view of the tube squeezer shown in FIGS. 1A-1C.
Figure 2B:
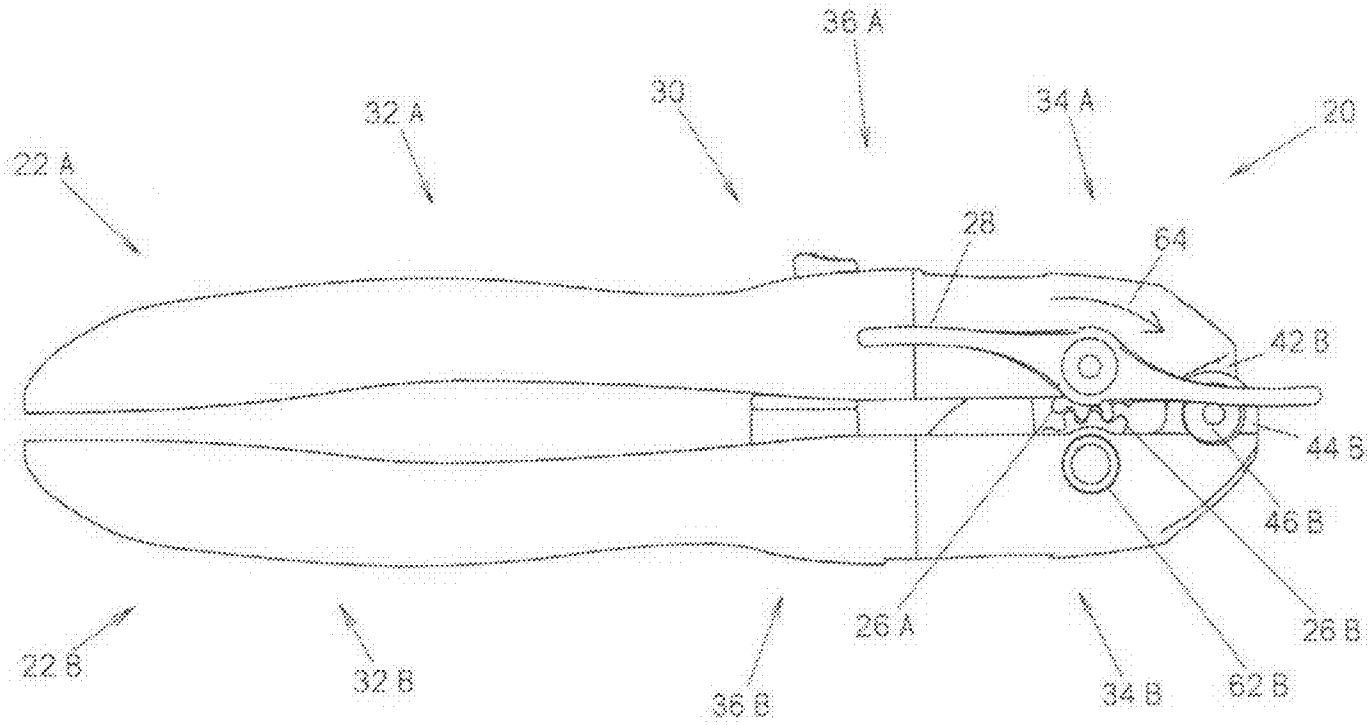
Figure 3:
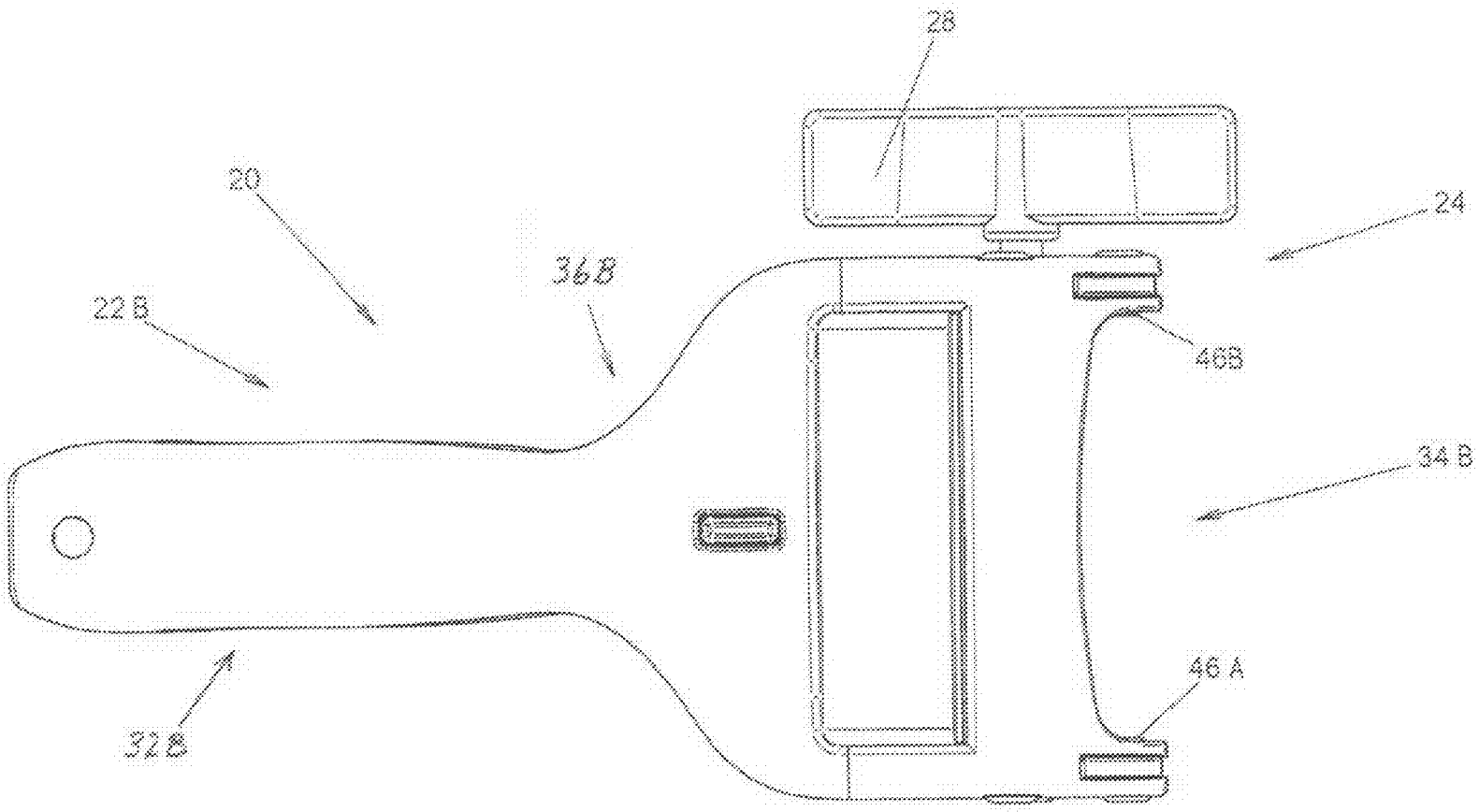
FIG. 3 is a bottom plan view of the tube squeezer shown in FIGS. 1A-1C.
Figure 4:
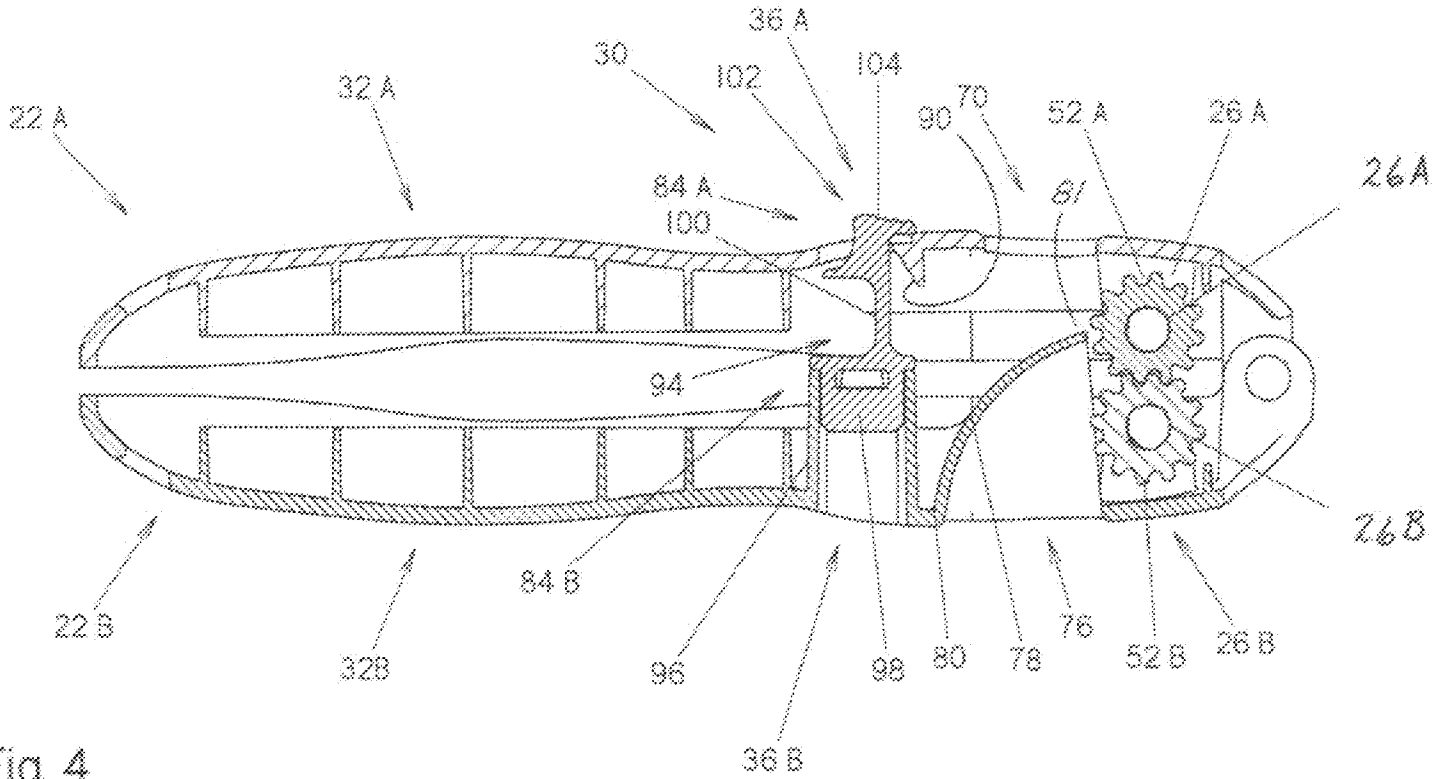
FIG. 4 is a cross-sectional view of the tube squeezer shown in FIGS. 1A-1C.
Figure 5:
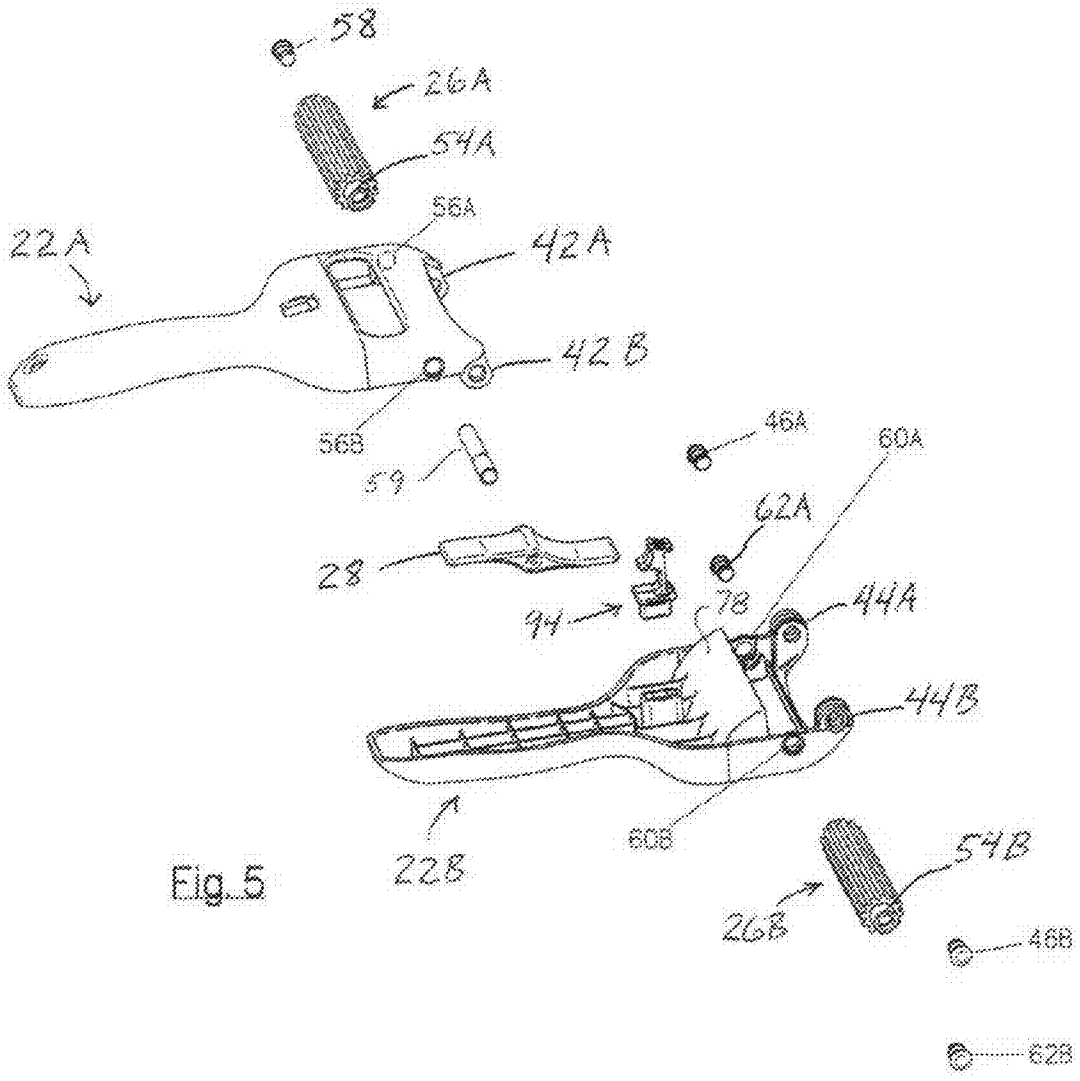
FIG. 5 is an exploded view of the tube squeezer shown in FIGS. 1A-1C.

When the first and second frames 22A, 22B are positioned as shown in FIGS. 2A and 2B, the toothed outer portions 52A, 52B mesh with one another. As such, when an operator uses the roller handle 28 to rotate the first roller 26A, the second roller 26B also rotates. Further, with reference to FIG. 2B, when the roller handle 28 is rotated in a clockwise direction indicated by arrow 64, the first and second rollers 26A, 26B respectively rotate in clockwise and counter-clockwise directions to pull a tube into tube squeezer 20 and to cause material in the tube to be ejected from the nozzle of the tube.

The first tube engagement portion 34A is generally comprised of first, second, third, and forth side portions 68A-68D that define an opening 70. The opening 70 will typically be facing a user during operation of the tube squeezer 20 and provide the user with the ability to observe at least the rotation of the first roller 26A. The opening 70 also reduces the weight and the amount of material in the tube squeezer 20 relative to a tube squeezer without such an opening, all other things being equal. Nonetheless, if weight and/or material and/or the ability to observe at least the rotation of the first roller 26A are of less concern, the opening 70 can be eliminated.

The second tube engagement portion 34B is generally comprised of first, second, third, and fourth side portion 74A-74D that define an opening 76. Also associated with the second tube engagement portion is a diverter 78 that serves to direct the portion of a tube that has passed between the first and second rollers 26A, 26B towards the opening 76 and away from hand of an operator that is grasping the handle formed by the first and second handle portions 32A, 32B. The diverter 78 extends from an edge 80 that defines a portion of the opening 76 to an edge 81 that is closer to the axis of rotation of the first roller 26A than to the axis of rotation of the second roller 26B. The diverter is 78 is curved and has a width that approximately the same as the lengths of the toothed outer portions 52A, 52B of the first and second rollers 26A, 26B. Further, the diverter 78 is integral with the second frame 22B. It should, however, be appreciated that a diverter that has a different shape is feasible, providing the diverter functions to direct the squeezed portion of a tube towards the opening 76. For example, the diverter can be planar instead of curved, extend over a lesser lateral extent, or have a comb shape that allows a user to see the squeezed portion of the tube as it passes between the first and second rollers 26A, 26B and towards the opening 76 via the opening 70. The diverter can also be a separate piece that is attached to the second frame 22B by a fastener.

The latch 30 is comprised of a first latch portion 84A that is associated with the first frame 22A and a second latch portion 84B that is associated with the second frame 22B. The first and second latch portions 84A, 84B operate so that first and second frames can be engaged to one another so as to prevent rotation of one frame relative to the other frame and disengaged from one another to allow such rotation. The first latch portion 84A includes a first engagement surface 86 that is located adjacent to a hole 88. In operation, the first engagement surface 86 contacts a surface associated with the second latch portion 84B to latch the first and second frames to one another and thereby prevent rotation of one frame relative to the other. The first latch portion 84A also includes a camming surface 90 that, in operation, engages a surface associated with the second latch portion 84B to direct a portion of the second latch portion 84B through the hole 88 so that the latch can be engaged. The camming surface 90 is integral with the first frame 22A. However, a separate camming surface that is fastened to the frame is also feasible. The second latch portion 84B is comprised of a flexible member 94 and a well 96 that is integral with the second frame 22B and receives a portion of the flexible member 94. The flexible member 94 includes a rimmed bottom portion 98 that engages the well 96 to support the remainder of the flexible member 94. The flexible member 94 further includes a staff 100 with one end attached to the rimmed bottom portion 98 and the other end attached to a flag 102. The flag 102 includes a knurled thumb surface 104 and second engagement surface 106. It should be appreciated that a different type of latch can also be employed. For example, a ball-and-socket type of latch can be employed. Further, a latch that is positioned at a different location can be employed. For example, a latch can be employed with latch portions that are each located at the distal end of the first and second handle portions 32A, 32B and so as not to interfere with the user's gripping of the handle. A latch can also be positioned closer to the first and second rollers 26A, 26B. In either of these cases, the disengaging of such a latch is not likely to be as convenient as the disengaging of latch 30, which can be accomplished with the same hand that the user is using to hold the handle of the tube squeezer 20.

The operation of the latch 30 is described. Initially, it is assumed that the first and second frames 22A, 22B are positioned such that the latch 30 cannot connect the first and second frames to one another. Subsequently, as the first and second frames 22A, 22B are brought closer to one another, the knurled thumb surface 104 of the second latch portion 84B engages the camming surface 90 of the first latch portion 84A. As the first and second frames 22A, 22B are brought yet closer to one another, the knurled thumb surface 104 and the camming surface 90 interact so as to cause the staff 100 to flex and direct the flag 102 through the hole 88. Once the second engagement surface 106 of the second latch portion 84B extends past the edge that defines the hole 88, the staff 100 can then straighten. The straightening of the staff 100 causes the second engagement surface 106 to engage the first engagement surface 86, thereby engaging the latch 30. To disengage the latch 30, the user pushes the knurled thumb surface 104 away from the first and second rollers 26A, 26B so as to cause the staff 100 to flex and the flag 102 to pass back through the hole 88 as the first and second frames 22A, 22B are separated from one another.

The first and second handle portions 32A, 32B, when positioned such that the first and second longitudinal axes 38A, 38B of the first and second frames 22A, 22B are substantially parallel to one another (e.g., FIGS. 2A and 2B), form a handle 110 that is of sufficient length and circumference to be gripped by the individual that is typically expected to use the tube squeezer 20. In this regard, it should be appreciated that the tube squeezer 20 can be scaled up and down for various applications and to accommodate that typical user in each such application.

Having described the various elements of the tube squeezer 20, the operation of the tube squeezer 20 is now described. The operation of the tube squeezer 20 is initially described when the tube squeezer 20 is in a storage or idle state in which the squeezer is not being used to squeeze material out of a collapsible tube. With reference to FIGS. 2A and 2B, when the tube squeezer 20 is in not being used to squeeze material out of a collapsible tube, the latch 30 is engaged such that the first and second frames 22A, 22B cannot rotate relative to one another. In this state, the tube squeezer 20 has a relatively low, planar profile and the first and second frames 22A, 22B cannot move relative to one another. The low, planar profile and latching of the first and second frames 22A, 22B to one another facilitates the storage of the tube squeezer 20 in a tool box, on a tool belt, in a pocket of a tool belt, or in or on any other type of structure for carrying or storing tools. Regardless of whether or not the latch 30 is engaged, the low, planar profile also facilitates efficient use of the space in a structure for carrying or storing tools. Further, the latching of the first and second frames 22A, 22B to one another prevents the first and second frames 22A, 22B from separating from one another and getting entangled with other tools or occupying more space than need be.

Figure 6:
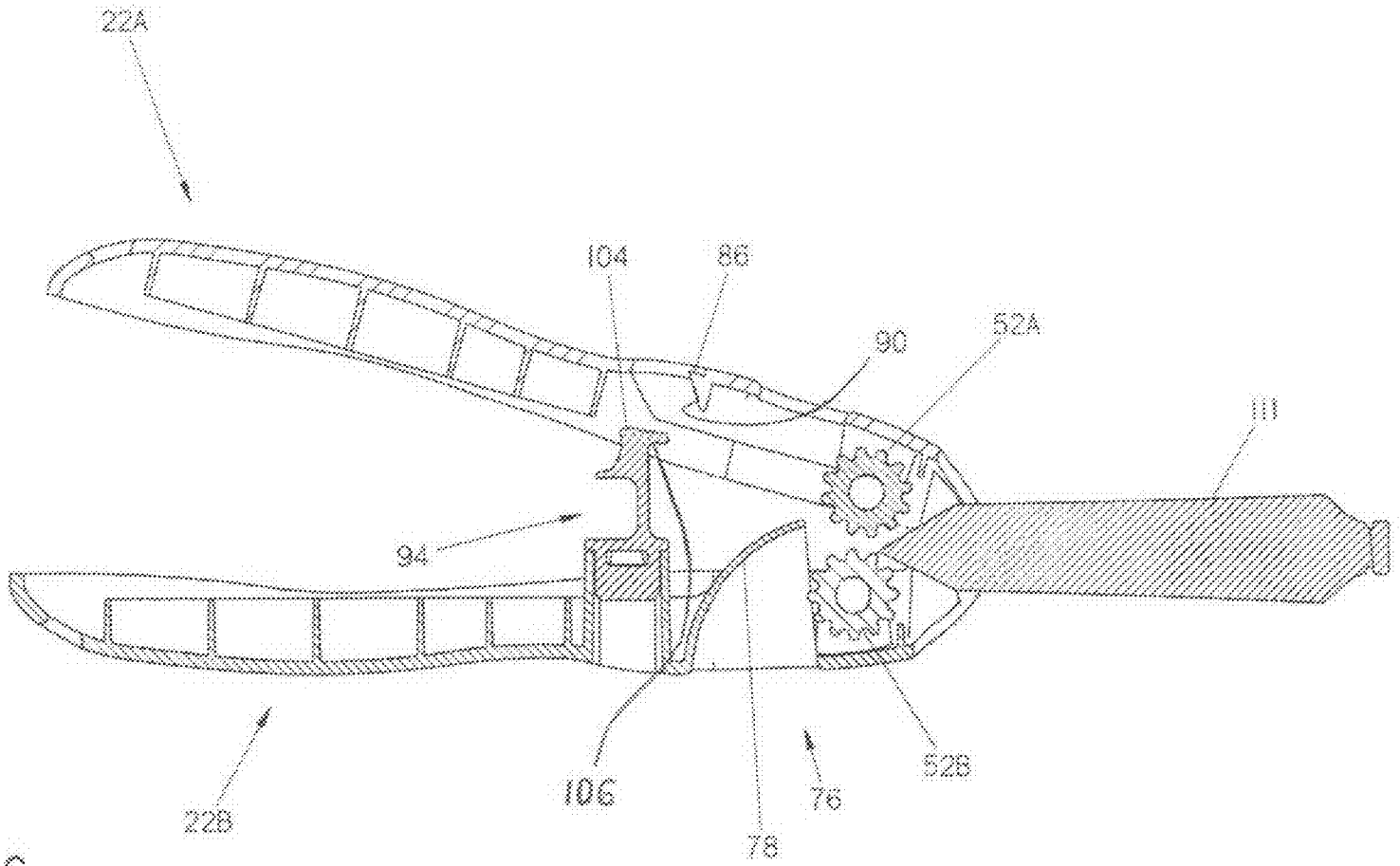
FIG. 6 is a cross-sectional view of the tube squeezer shown in FIGS. 1A-1C in a position suitable for initially engaging a tube.

With reference to FIG. 6, the operation of the tube squeezer 20 is now described with respect to a tube receiving state, i.e., the state in which the tube squeezer 20 initially engages a collapsible tube 111. In this state, the latch 30 is disengaged so that the first and second frames 22A, 22B can be rotated relative to one another and a space sufficient to receive a portion of the flexible tubular body of a collapsible tube established between the first and second rollers 26A, 26B. With this spacing established, the flexible tubular body of the tube is placed between the first and second rollers 26A, 26B and the first and second frames 22A, 22B are then brought closer to one another until the flexible tubular body of the tube is engaged by the first and second rollers 26A, 26B, thus transitioning the tube squeezer 20 from the tube receiving state to the tube engagement state. Generally, the first and second frames 22A, 22B are brought close enough to one another so that the latch 30 is also engaged. However, the latch 30 need not be engaged for tube squeezer 20 to enter the tube engagement state. e Moreover, the latch 30 (if engaged) typically does not provide enough compressive force for the continuous squeezing of material out of the collapsible tube, that force is provided by the user's hand squeezing the first and second handle portions 32A, 32B together. Nonetheless, when the latch 30 is engaged, the latch provides enough force so that the user can release the handle 110 without also releasing the tube and having to repeat the process of engaging the tube squeezer 20 and the collapsible tube. At this point, the first and second handle portions 32A, 32B form the handle 110. The handle 110 has a longitudinal axis 112 that is perpendicular to a roller plane 116 that is defined by the rotational axes of the first and second rollers 26A, 26B. The longitudinal axis 112 of the handle 110 also lies in the tube exit plane 118, a plane that is perpendicular to the roller plane 116 and midway between the axes of rotation of the first and second rollers 26A, 26B.

Figure 7:
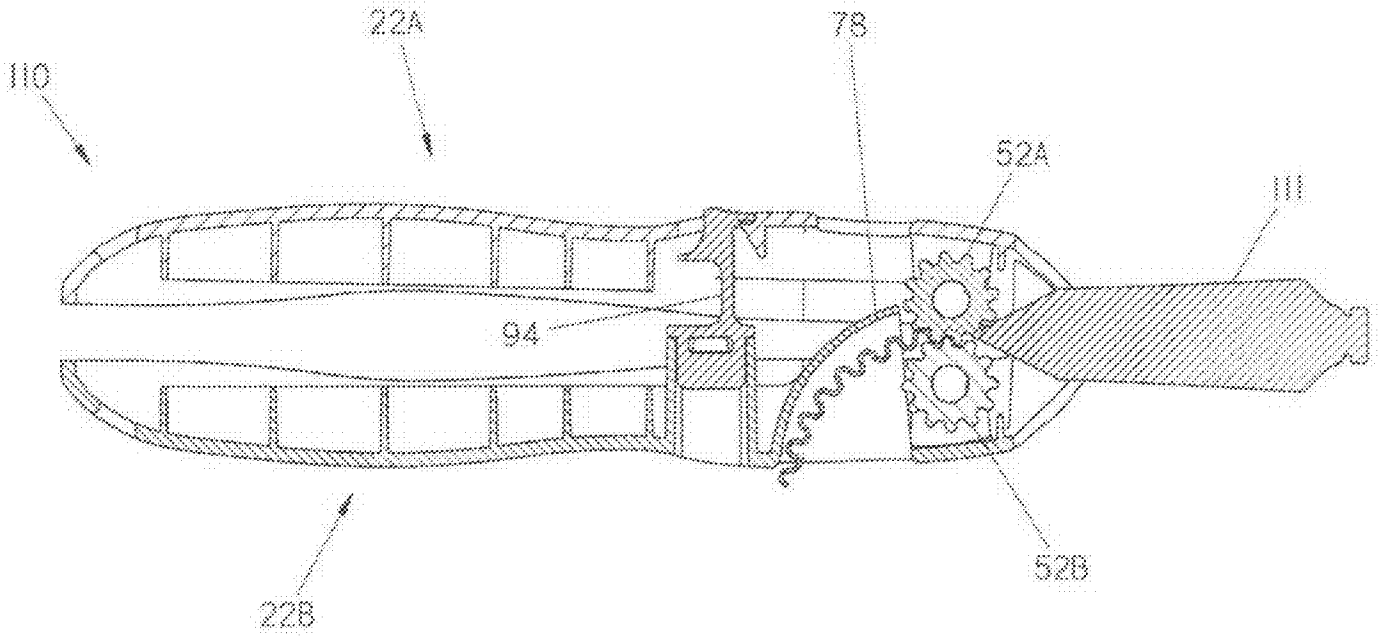
FIG. 7 is a cross-sectional view of the tube squeezer shown in FIGS. 1A-1C in position for squeezing a tube and the portion of the tube that has been squeezed being diverted away from the user's hand.

With reference to FIG. 7, the operation of the tube squeezer 20 in forcing material out of the nozzle of the tube is described. After the tube squeezer 20 and a collapsible tube have been engaged, the user grasps the handle 110 with one hand and the roller handle 28 with the other hand. The grasping of the handle 110 forces the first and second handle portions 32A, 32B closer to one another and provides a substantial portion of the compressive force that is transmitted via the first and second rollers 26A, 26B to the flexible tubular body of the tube. In addition, the compressive force causes the first and second rollers 26A, 26B to pinch the flexible tubular portion between the toothed outer portions 52A, 52B of the first and second rollers 26A, 26B. The rotation of the roller handle 28 in a clockwise direction causes the toothed outer portions 52A, 52B of the first and second rollers 26A, 26B to pull the flexible tubular portion into the squeezer 20 to produced a squeezed portion of the tube that engages the diverter 78 and is directed towards the opening 76. It should be appreciated that the squeezed portion of the tube is directed away from the hand of the user that is grasping the handle 110 and, in most cases, directed so as not to interfere with the user's view of the application of the material from the tube to a particular surface.

Removal of the tube from the tube squeezer 20 is accomplished by, if necessary, releasing the latch 30 and separating the first and second frames 22A, 22B from one another so that the tube can readily removed from between the first and second rollers 26A, 26B.

The foregoing description of the invention is intended to explain the best mode known of practicing the invention and to enable others skilled in the art to utilize the invention in various embodiments and with the various modifications required by their particular applications or uses of the invention.

What is claimed is:

1. A two-handed tube squeezer comprising:

a first frame comprising a first handle portion and a first tube engagement portion that is operatively attached to the first handle portion, the first handle portion having a first longitudinal axis;

a second frame comprising a second handle portion and a second tube engagement portion that is operatively attached to the second handle portion, the second handle portion having a second longitudinal axis;

a first roller operatively attached to the first frame and capable of rotation about a first rotational axis;

the first tube engagement portion having a first U-shaped section extending from one end of the first roller to the other end of the first roller;

the first handle portion extending away from the first U-shaped section;

a second roller operatively attached to the second frame and capable of rotation about a second rotational axis;

the second tube engagement portion having a second U-shaped section extending from one end of the second roller to the other end of the second roller;

the second handle portion extending away from the second U-shaped section;

a roller handle operatively attached to the first roller;

a hinge for pivotally connecting the first and second frames, the hinge allowing the first and second frames to be placed in a first position in which the first and second longitudinal axes are substantially parallel to but separated from one another;

wherein when the first and second frames are in the first position, the first and second rollers define a roller plane that includes the first and second rotational axes and a tube exit plane that is perpendicular to the roller plane and passes between the first and second rollers;

wherein the second frame defines an exit hole that is located between the second U-shaped section and the second roller, the exit hole being at least partially defined by an edge associated with a portion of the second U-shaped section that is located between the second handle portion and the second roller, wherein the edge is sufficiently spaced from the second roller so as to allow a portion of a squeezed tube to pass through the exit hole located between the edge and the second roller;

a diverter surface operatively attached to the second frame and extending from a location adjacent to the edge of the exit hole to a location that is beyond the tube exit plane and towards the first and second rollers, wherein no portion of the diverter surface located between the tube exit plane and the exit hole and capable of engaging a squeezed portion of a tube is parallel to the tube exit plane; and wherein when the first and second frames are in the first position, (a) the first and second handle portions form a handle suitable for grasping by a user, (b) the first and second rollers are positioned for squeezing a tube, and (c) the diverter surface is positioned to engage and direct a squeezed portion of a tube towards the exit hole, away from the handle, and not specifically towards the nozzle of a tube.

2. A two-handed tube squeezer, as claimed in claim 1, wherein:

the diverter surface includes a curved surface.

3. A two-handed tube squeezer, as claimed in claim 1, wherein:

the diverter surface includes a straight surface.

* * * * *